US012433420B2

(12) United States Patent
Ford

(10) Patent No.: US 12,433,420 B2
(45) Date of Patent: Oct. 7, 2025

(54) SYSTEMS AND METHODS FOR CIRCULATING AIR THROUGH A BED FRAME

(71) Applicant: Emmett Ford, Salt Lake City, UT (US)

(72) Inventor: Emmett Ford, Salt Lake City, UT (US)

(73) Assignee: Emmett Ford, Salt Lake City, UT (US)

( * ) Notice: Subject to any disclaimer, the term of this patent is extended or adjusted under 35 U.S.C. 154(b) by 444 days.

(21) Appl. No.: 17/935,838

(22) Filed: Sep. 27, 2022

(65) Prior Publication Data

US 2024/0099473 A1 Mar. 28, 2024

(51) Int. Cl.

| | |
|---|---|
| ***A47C 21/04*** | (2006.01) |
| ***A47C 19/02*** | (2006.01) |
| ***A47C 19/20*** | (2006.01) |
| ***A47C 19/22*** | (2006.01) |

(52) U.S. Cl.

CPC ..... *A47C 21/044* (2013.01); *A47C 19/021* (2013.01); *A47C 19/20* (2013.01); *A47C 19/22* (2013.01)

(58) Field of Classification Search

CPC ..... A47C 21/04; A47C 21/044; A47C 19/021; A47C 19/20; A47C 19/22; A47C 19/022

See application file for complete search history.

(56) References Cited

U.S. PATENT DOCUMENTS

| | | | | |
|---|---|---|---|---|
| 3,928,876 A * | 12/1975 | Starr | A47C 21/044 | 5/284 |
| 5,020,176 A * | 6/1991 | Dotson | A47C 27/18 | 5/672 |
| 10,342,358 B1 * | 7/2019 | Palashewski | A61G 7/018 | |
| 10,524,581 B2 * | 1/2020 | Aramli | A47C 21/044 | |
| 10,973,337 B2 * | 4/2021 | Ermalovich | A47C 17/04 | |
| 11,313,129 B1 * | 4/2022 | Gray | E04D 13/17 | |
| 2008/0148481 A1 * | 6/2008 | Brykalski | A47C 21/048 | 5/423 |
| 2009/0064415 A1 * | 3/2009 | Payne | A47C 21/08 | 5/658 |

(Continued)

FOREIGN PATENT DOCUMENTS

| | | | | |
|---|---|---|---|---|
| CN | 201840105 U * | 5/2011 | A47C 19/20 | |
| CN | 107660926 A * | 2/2018 | A47C 21/044 | |

OTHER PUBLICATIONS

BEDJET; "End sleepless nights with the worlds #1 best-selling cooling & warming sleep system for beds"; Webpage; 2022; accessed on Sep. 27, 2022; 6 pages; located at: https://bedjet.com/?utm_source=google&utm_medium=cpc&utm_campaign=upper-direct&utm_term=bed%20air%20conditioner&gclid=CjwKCAjwvsqZBhAIEiwAqAHElajYBXKXIFu50ECe5tVW3YJcNRbvRSE-9ecuP52-z5DYpwSEQn3tnxoCZd4QAvD_BwE.

*Primary Examiner* — David R Hare
*Assistant Examiner* — George Samuel Gines
(74) *Attorney, Agent, or Firm* — MASCHOFF BRENNAN

(57) ABSTRACT

Systems and methods for circulating air through a bed frame are provided. In one embodiment, a system may include a bed frame that defines an internal chamber. A first vent in the bed frame may be configured to receive air from outside the internal chamber to inside the internal chamber. A second vent in the bed frame may be configured to expel air from inside the internal chamber to outside the internal chamber. A fan disposed within the internal chamber between the first vent and the second vent may be configured to move air within the internal chamber from the first vent to the second vent.

17 Claims, 8 Drawing Sheets

(56) References Cited

U.S. PATENT DOCUMENTS

| | | | | |
|---|---|---|---|---|
| 2010/0011502 | A1* | 1/2010 | Brykalski | A61G 7/05 5/423 |
| 2011/0115635 | A1* | 5/2011 | Petrovski | A47C 31/008 340/584 |
| 2012/0172959 | A1* | 7/2012 | Lachenbruch | A61F 7/0085 5/423 |
| 2015/0272338 | A1* | 10/2015 | Greener | A47C 31/00 5/423 |
| 2017/0360212 | A1* | 12/2017 | Rawls-Meehan | A47C 21/044 |

* cited by examiner

SYSTEMS AND METHODS FOR CIRCULATING AIR THROUGH A BED FRAME

BACKGROUND

Due to the fact that cool air is more dense, and therefore heavier than warm air, gravity pulls cool air downward, forcing lighter warm air to rise. This principle is known as heat convection. Heat convection makes it difficult to distribute air having a consistent temperature uniformly in an enclosed area because cool air tends to pool at the bottom of the area while warm air tends to rise toward the top. An attempt to cool a top portion of the enclosed area requires cooling the entire area, as the cool air will fill the area from the bottom up. On the other hand, an attempt to warm a bottom portion of the enclosed area requires warming the entire area, as the warm air will fill the area from the top down.

In bedrooms, cool dense air pools at the floor while warm air rises to the ceiling. Due to heat convection, it is easier to get cool air to beds with mattress platforms that are close to the floor. On the other hand, it is easier to get warm air to beds with mattress platforms that are elevated, such as loft beds. Bunk beds present a unique problem because there are two (or more) mattress platforms at different elevations within the room. During the summer, when cooling units are attempting to cool the bedroom, the cool air that pools near the floor of the room may not reach a person that is on an elevated platform of a loft bed or bunk bed. In the winter, the opposite problem may be encountered. When a furnace or other heating unit is attempting to warm the room, the warm air that rises toward the ceiling may not reach a person that is on a mattress platform that is close to the floor, such as a bottom bunk of a bunk bed.

The subject matter claimed herein is not limited to embodiments that solve any disadvantages or that operate only in environments such as those described above. Rather, this background is only provided to illustrate one example technology area where some embodiments described herein may be practiced.

SUMMARY

In one embodiment, a system for circulating air through a bed frame is disclosed. The system may include a bed frame that defines an internal chamber; a first vent in the bed frame, the first vent being configured to receive air from outside the internal chamber to inside the internal chamber; a second vent in the bed frame, the second vent being configured to expel air from inside the internal chamber to outside the internal chamber; and a fan disposed within the internal chamber between the first vent and the second vent, the fan being configured to move air within the internal chamber from the first vent to the second vent.

In some embodiments, the bed frame may be a bunk bed frame having a lower bunk assembly and an upper bunk assembly, the first vent may be in the lower bunk assembly, and the second vent may be in the upper bunk assembly. In these embodiments, the first vent may also be configured to expel air from inside the internal chamber to outside the internal chamber, the second vent may also be configured to receive air from outside the internal chamber to inside the internal chamber, and the fan may be bidirectional such that in a first directional setting, it is configured to move air within the internal chamber from the first vent to the second vent, and in a second directional setting it may be configured to move air within the internal chamber from the second vent to the first vent.

In some embodiments, the system may further include a controller that that may be configured to adjust a directional setting of the fan. In these embodiments, the controller may be further configured to adjusts a speed setting of the fan. In some embodiments, the controller may be in wired communication with the fan, in other embodiments, the controller may be in wireless communication with the fan.

In some embodiments, the bed frame may include a vertical support leg having an upper end and a lower end, the upper end of the vertical support leg may include a telescoping portion that is configured to selectively extend the height of the upper end of the vertical support leg, the first vent may be in the telescoping portion of the vertical support leg, and the second vent may be in the lower end of the vertical support leg.

In another embodiment, a system for circulating air through a bed frame from a lower elevation to a higher elevation is disclosed. The system may include a bed frame that defines an internal chamber that has a lower end at or near the bottom of the bed frame and a higher end at or near the top of the bed frame; an intake vent at or near the lower end of the internal chamber, the intake vent being configured to receive air into the internal chamber; an outflow vent at or near the higher end of the internal chamber, the outflow vent being configured to expel air from inside the internal chamber; and a fan within the internal chamber, the fan being configured to move air within the internal chamber from the intake vent to the outflow vent.

In some embodiments, the system may further include a length of duct having a first end and a second end. The first end of the length of duct may be connected to the intake vent and the second end of the length of duct may be configured to be secured to all or part of a HVAC wall register.

In some embodiments, the outflow vent may be adjustable such that the direction that air is configured to be expelled from inside the chamber can be pointed in a desired direction.

In some embodiments, the bed frame may include a headboard and the outflow vent may be in the headboard.

In some embodiments, the bed frame may include a horizontal guard rail at or near the top of the bed frame and the outflow vent may be in the horizontal guard rail.

In some embodiments, the system may further include a tube that is connected, at one end, to the outflow vent.

In yet another embodiment, a system for circulating air through a bed frame is disclosed. The system may include a bunk bed frame having a lower bunk assembly and an upper bunk assembly; an internal chamber that extends within the bunk bed frame from the lower bunk assembly to the upper bunk assembly; a first intake vent in the lower bunk assembly that is configured to receive air from outside the internal chamber to inside the internal chamber; a first outflow vent in the in the upper bunk assembly that is configured to expel air from inside the internal chamber to outside the internal chamber; a second intake vent in the upper bunk assembly that is configured to receive air from outside the internal chamber to inside the internal chamber; a second outflow vent in the in the lower bunk assembly that is configured to expel air from inside the internal chamber to outside the internal chamber; a bidirectional fan disposed within the internal chamber wherein, in a first directional setting, the bidirectional fan is configured to pull air into the internal chamber through the first intake vent and expel air from within the internal chamber through the first outflow vent and, in a second directional setting, the bidirectional fan is configured to pull air into the internal chamber through the second intake vent and expel air from within the internal chamber through the second outflow vent; and a controller that is configured to control the directional setting of the bidirectional fan.

In some embodiments, the system may further include a first intake valve that selectively opens and closes access by the internal chamber to the first intake vent; a first outflow valve that selectively opens and closes access by the internal chamber to the first outflow vent; a second intake valve that selectively opens and closes access by the internal chamber to the second intake vent; and a second outflow valve that selectively opens and closes access by the internal chamber to the second outflow vent. In these embodiments, in the first directional setting, the first intake valve and the first outflow valve may be in open positions and the second intake valve and the second outflow valve may be in closed positions. In the second directional setting, the first intake valve and the first outflow valve may be in closed positions and the second intake valve and the second outflow valve may be in open positions.

In some embodiments, the upper bunk assembly may include a headboard, and the first outflow vent may be positioned in the headboard of the upper bunk assembly.

In some embodiments, the upper bunk assembly may include a horizontal guard rail, and the first outflow vent may be positioned in the horizontal guard rail of the upper bunk assembly.

In some embodiments, the system may further include a tube connected at one end to the first outflow vent of the upper bunk assembly.

It is to be understood that both the foregoing summary and the following detailed description are explanatory and are not restrictive of the invention as claimed.

BRIEF DESCRIPTION OF THE DRAWINGS

Embodiments will be described and explained with additional specificity and detail through the use of the accompanying drawings in which.

DETAILED DESCRIPTION

Cool air is more dense, and heavier, than warm air. Gravity, therefore, pulls cool air downward, forcing warm air to rise through a principle known as heat convection. Heat convection is what makes hot air balloons rise. Heat convection is also responsible for the thermal lifts that many bird species use to effortlessly gain altitude. The principle of heat convection, however, makes the distribution of warm or cool air uniformly within an enclosed area difficult.

In an enclose area, such as a bedroom, heat convection causes cool air to pool at the bottom of the area and warm air to rise toward the top. An attempt to cool a top portion of the bedroom requires cooling the entire area, as the cool air will fill the area from the bottom up. On the other hand, an attempt to warm a bottom portion of the bedroom requires warming the entire area, as the warm air will fill the area from the top down. If there is a window open or door ajar in the bedroom, it may be impossible to uniformly distribute air having the same temperature, as warm or cool air may escape before entirely filling the room.

Thus, during the summer, when cooling units are attempting to cool a bedroom, the cool air that pools near the floor of the room may not reach a person that is in an elevated mattress platform of a loft bed. In the winter, when a furnace or other heating unit is attempting to warm the room, the warm air that rises toward the ceiling may not reach a person that is in a bed that is on a mattress platform that is close to the floor. Bunk beds present a unique problem, as they include mattress platforms at different levels. It is common that either the person on the top bunk is too warm, or the person on the bottom bunk to is too cold, or sometimes both.

Some embodiments disclosed herein may enable the circulation of air through a bed frame. In particular, in some embodiments, the system may include a bed frame that defines an internal chamber. A first vent in the bed frame may be configured to receive air from outside the internal chamber to inside the internal chamber. A second vent in the bed frame may be configured to expel air from inside the internal chamber to outside the internal chamber. A fan disposed within the internal chamber between the first vent and the second vent may be configured to move air within the internal chamber from the first vent to the second vent.

Figure 1A:
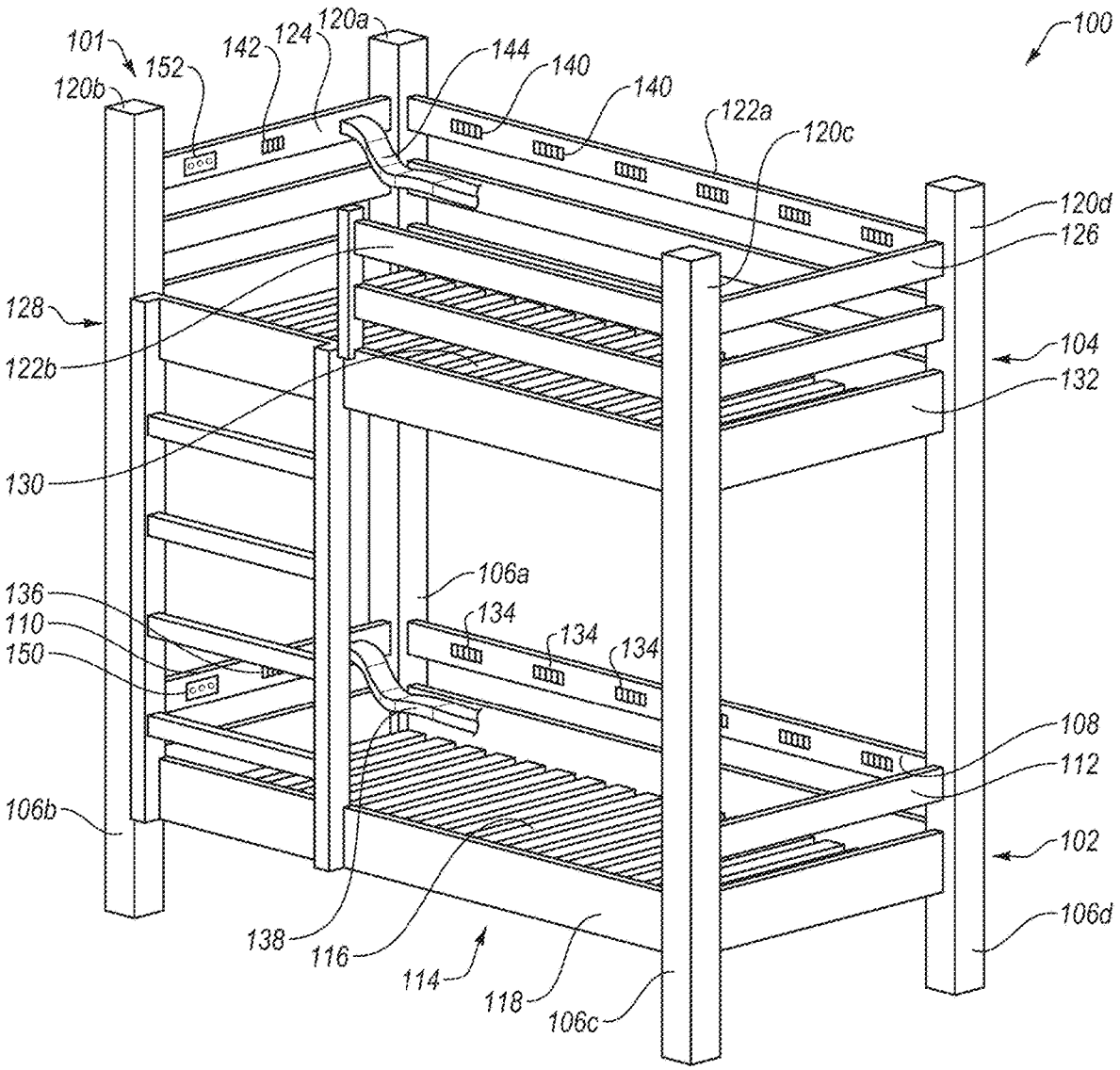
FIG. 1A illustrates a perspective view of a first system for circulating air through a bed frame.

Turning to the figures, FIG. 1A illustrates a first system 100 for circulating air through a bed frame. The bed frame in the system 100 is a bunk bed frame 101 having a lower bunk assembly 102 and an upper bunk assembly 104. The bunk bed frame 101 may be constructed in whole or in part from wood, metal, plastic, or some other suitable material.

The lower bunk assembly 102 includes vertical support legs 106*a*, 106*b*, 106*c*, and 106*d*, a horizontal guard rail 108, a headboard 110, and a footboard 112. The lower bunk assembly 102 also includes a lower mattress platform 114. The lower mattress platform 114 includes cross members 116 and a mattress support box 118 that are configured to support a lower mattress (not shown).

The upper bunk assembly 104 includes vertical support legs 120*a*, 120*b*, 120*c*, and 120*d*, horizontal guard rails 122*a* and 122*b*, a headboard 124, and a footboard 126. The upper bunk assembly 104 also includes an upper mattress platform 128. The upper mattress platform 128 includes cross members 130 and a mattress support box 132 that are configured to support an upper mattress (not shown).

In some embodiments, the vertical support legs 106*a*, 106*b*, 106*c*, and 106*d* of the lower bunk assembly 102 may be separate components from the vertical support legs 120*a*, 120*b*, 120*c*, and 120*d* of the upper bunk assembly 104. In these embodiments, the vertical support legs 106*a*, 106*b*, 106*c*, and 106*d* of the lower bunk assembly 102 may be configured to interface with corresponding vertical support legs 120*a*, 120*b*, 120*c*, and 120*d* of the upper bunk assembly 104 in order to secure the upper bunk assembly 104 above the lower bunk assembly 102. For example, support plates may be attached to a top portion of the vertical support legs

106*a*, 106*b*, 106*c*, and 106*d* of the lower bunk assembly 102 and a bottom portion of the corresponding vertical support legs 120*a*, 120*b*, 120*c*, and 120*d* of the upper bunk assembly 104. Posts or rails that extend through a top portion of the vertical support legs 106*a*, 106*b*, 106*c*, and 106*d* of the lower bunk assembly 102 and a bottom portion of the corresponding vertical support legs 120*a*, 120*b*, 120*c*, and 120*d* of the upper bunk assembly 104 may also be used to secure the lower bunk assembly 102 to the upper bunk assembly 104.

In other embodiments, the vertical support legs 106*a*, 106*b*, 106*c*, and 106*d* of the lower bunk assembly 102 may not be separate components from the vertical support legs 120*a*, 120*b*, 120*c*, and 120*d* of the upper bunk assembly 104. In these embodiments, the vertical support legs 106*a* and 120*a* may be constructed from a unitary piece of material, the vertical support legs 106*b* and 120*b* may be constructed from a unitary piece of material, the vertical support legs 106*c* and 120*c* may be constructed from a unitary piece of material, and the vertical support legs 106*d* and 120*d* may be constructed from a unitary piece of material.

The bunk bed frame 101 may define an internal chamber (see FIG. 1B) that extends from the lower bunk assembly 102 to the upper bunk assembly 104. One or more vents may be in fluid communication with the internal chamber to allow air to flow into and out of the internal chamber. A fan (shown in FIG. 1B) may also be disposed within the internal chamber. The fan may be powered by one or more batteries, or a cable that is configured to be plugged into a power outlet, or another source of power. The fan may be configured to move air into and out of the internal chamber through the one or more vents.

For example, the lower bunk assembly 102 includes several outflow vents, including outflow vents 134, which are positioned in the guard rail 108 of the lower bunk assembly 102. Another outflow vent 136 is positioned in the headboard 110 of the lower bunk assembly 102. A hose 138 may be secured, at one end, to another outflow vent in the lower bunk assembly 102. The hose 138 may be pliable in order to be position in a desired location. In some embodiments, the hose 138 may be configured to blow air into a mattress on the lower mattress platform 114. In some embodiments, additional outflow vents may be positioned within the footboard 112, the lower mattress platform 114, or in another place in the lower bunk assembly 102.

The upper bunk assembly 104 also includes several outflow vents, including outflow vents 140, which are positioned in the guard rail 122*a* of the upper bunk assembly 104. Another outflow vent 142 is positioned in the headboard 124 of the upper bunk assembly 104. A hose 144 may be secured, at one end, to another outflow vent in the upper bunk assembly 104. The hose 144 may be pliable in order to be position in a desired location. In some embodiments, the hose 144 may be configured to blow air into a mattress on the upper mattress platform 128. In some embodiments, additional outflow vents may be positioned within the footboard 126, the upper mattress platform 128, or in another place in the upper bunk assembly 104.

The outflow vents 134, 136, 140, and 142 may include slats that can be selectively adjusted such that the direction that air is expelled from inside the internal chamber can be pointed in a desired direction. In some embodiments, the vents 134, 136, 140, and 142 may include mechanisms that cause the slats to reciprocate, expelling air from inside the chamber in different directions. In some embodiments, the reciprocating mechanism may cause the air to be expelled in 180 degrees, 90 degrees, or some other angular range.

Controllers 150 and 152 may be in electrical communication with the fan and any electrical components of the system, including the vents 134, 136, 140, and 142. The controllers 150 and 152 may be configured to control a fan direction, a fan speed, and other adjustable features of the system 100. The controllers 150 and 152 in the system 100 are secured to the headboards 110 and 124 of the bunk bed frame 101. However, the controllers 150 and 152 may be located anywhere on bunk bed frame 101. In some embodiments, the controllers 150 and 152 may be portable and may be in wireless communication with the electronic components of system 100. Any wireless communication method may be used to facilitate the communication between the controllers 150 and 152 and the electrical components of the system. In some embodiments, the wireless communication may use a radio frequency or light frequency transmitter. In other embodiments, the wireless communication may use a network such as a Personal Area Network (PAN), a Local Area Network (LAN), a Metropolitan Area Network (MAN), a Wide Area Network (WAN), a Storage Area Network (SAN), a cellular network, the Internet, or some combination thereof.

In embodiments where the vertical support legs 120*a*, 120*b*, 120*c*, and 120*d* of the upper bunk assembly 104 and the vertical support legs 106*a*, 106*b*, 106*c*, and 106*d* of the lower bunk assembly 102 are separate, non-unitary components, a collar may be positioned within an internal chamber at a connection interface between an upper and lower vertical support leg to ensure that air within the internal chamber does not escape through the connection seam between the upper and lower vertical support legs. The collar may extend into a portion of the internal chamber in a lower support leg and also extend into a portion of the internal chamber in a corresponding upper support leg and have a flange that maintains the collar between at the connection of these components. For example, the flange may be positioned in between a surface on the lower vertical support leg that supports the weight of the upper vertical support leg. In other embodiments, the collar may be on the outside of the vertical support legs.

Figure 1B:
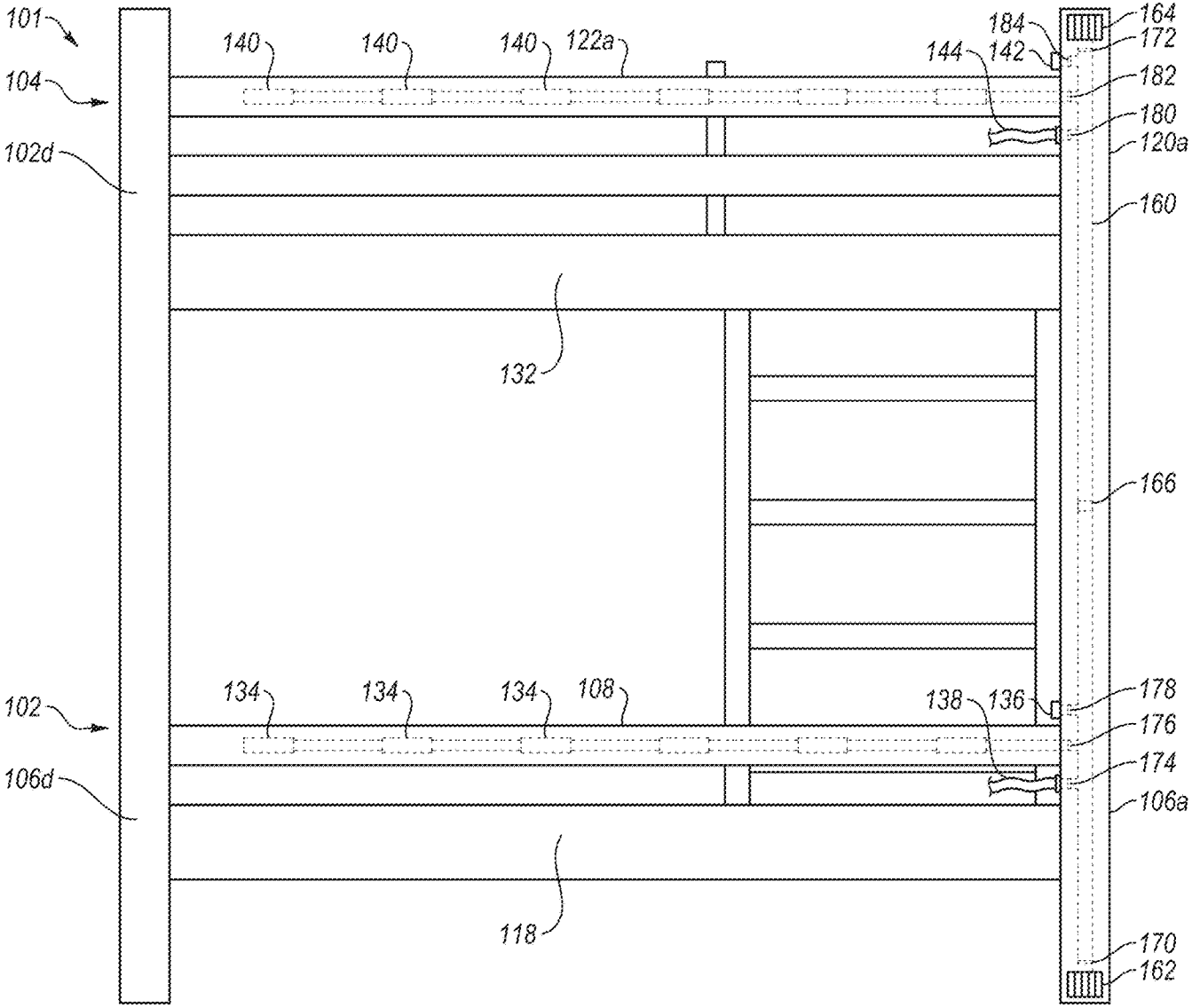
FIG. 1B illustrates a back view of the first system for circulating air through a bed frame.

FIG. 1B illustrates a back view of the first system 100 for circulating air through a bed frame. A first intake vent 162 is in a lower portion of the vertical support leg 106*a* of the lower bunk assembly 102. A second intake vent 164 is in an upper portion of the vertical support leg 120*a* of the upper bunk assembly 104. An internal chamber 160 (shown in dashed lines) extends within the vertical support legs 106*a* and 120*a* and connects the first intake vent 162 with the second intake vent 164. A fan 166 is contained within the internal chamber 160 between the first intake vent 162 and the second intake vent 164.

In some embodiments, an access door in the frame near the fan 166 may provide access to the fan 166. Through this access door, the fan 166 may be services or debris that may have fallen down the internal chamber 160 that is interfering with the function of the fan 166 may be removed.

Intake and outflow vents, according to the present disclosure, can be located anywhere on the bunk bed frame 101. In some embodiments, for example, an intake vent may be located on the top of a vertical support leg or on an inner side of a bed frame leg. In other embodiments, an intake vent may be located on a mattress platform or some other part of the frame. In addition, in some embodiments, a filter that is configured to remove dust and other particles from the air may be positioned within the internal chamber 160. In one embodiment, the filter may be secured to the inner side of the first and second intake vents 162 and 164.

The internal chamber 160 can extend through any portion of the bunk bed frame 101. For example, in the lower bunk assembly 102 of bunk bed frame 101, the internal chamber 160 extends through the vertical support leg 106*a*, through the headboard 110 to the outflow vent 136, and through the horizontal guard rail 108 to the outflow vents 134. In the upper bunk assembly 104 of bunk bed frame 101, the internal chamber 160 extends through the vertical support leg 120*a*, through the headboard 124 to the outflow vent 142, and through the horizontal guard rail 122*a* to the outflow vents 140. In some embodiments, the internal chamber 160 may also extend into the lower and upper mattress platforms 114 and 128, to additional outflow vents that are located in these parts of the frame.

The cross sectional shape of a bed frame according to the present disclosure can have any shape. In some embodiments, the bed frame, or portion of the bed frame, may be square, rectangular, circular, oval, etc. The internal chambers within the bed frame may also have any cross sectional shape. In some embodiments, the cross sectional shape of an internal chamber may be the same as the cross sectional shape of the bed frame. For example, a vertical support leg may have a circular cross sectional shape, and an internal chamber within the vertical leg may also have a circular cross sectional shape. In other embodiments, an internal chamber may have a different cross sectional shape than the frame. For example, a vertical support leg may have a square or rectangular cross sectional shape, and an internal chamber within the vertical leg may have a circular cross sectional shape.

In addition, the one or more vertical support leg that contain an internal chamber may have the same or a different size than the one or more vertical support legs that do not include an internal chamber. For example, with regard to the first system 100, the vertical support legs 106*a* and 120*a* (which include the internal chamber 160) are the same approximate size as the vertical support legs 106*b*-106*d* and 120*b*-120*d*, which do not include the internal chamber 160. However, in other embodiments, the vertical support legs 106*a* and 120*a* (which include the internal chamber 160) may be larger than the vertical support legs 106*b*-106*d* and 120*b*-120*d*, which do not include the internal chamber 160.

The first system 100 may also include valves that are configured to selectively open and close access by the internal chamber 160 to one or more of the vents. For example, valve 170 selectively opens and closes access, by the internal chamber 160, to the first intake vent 162. Valve 172 selectively opens and closes access, by the internal chamber 160, to the second intake vent 164. Valve 174 selectively opens and closes access, by the internal chamber 160, to the outflow vent connected to hose 138. Valve 176 selectively opens and closes access, by the internal chamber 160, to the outflow vents 134. Valve 178 selectively opens and closes access, by the internal chamber 160, to the outflow vent 136. Valve 180 selectively opens and closes access, by the internal chamber 160, to the outflow vent connected to hose 144. Valve 182 selectively opens and closes access, by the internal chamber 160, to the outflow vents 140. Valve 184 selectively opens and closes access, by the internal chamber 160, to the outflow vent 142.

In some embodiments, the valves 170-184 may be selectively opened and closed by an electronic actuator. In other embodiments, mechanical levers or switches may be manually adjusted in order to selectively open and close the valves.

Figure 1C:
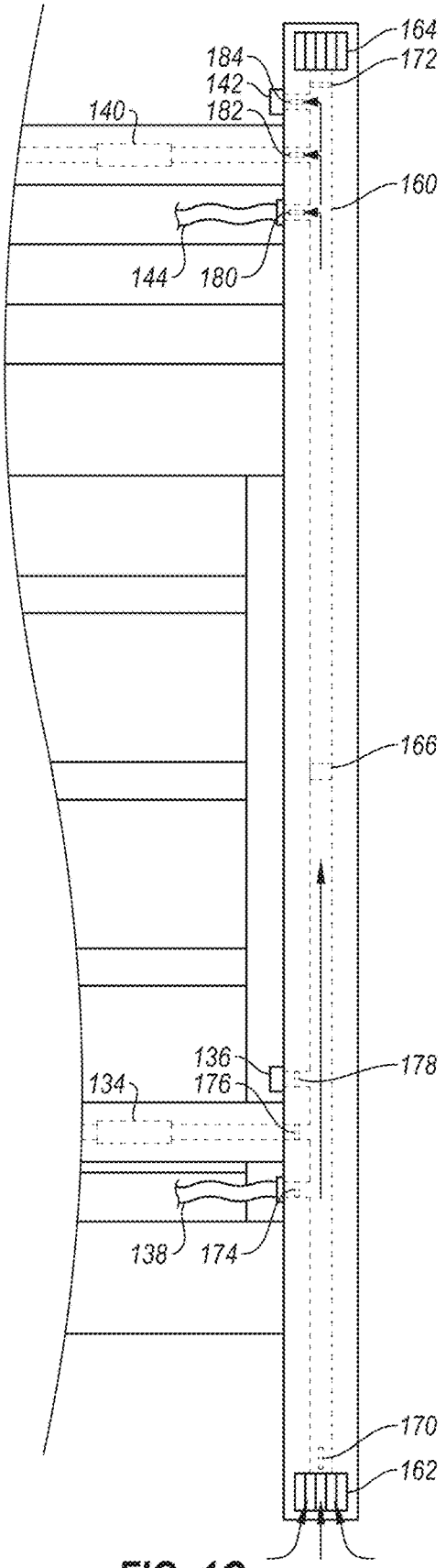
FIG. 1C illustrates a back view of the first system for circulating air through a bed frame in a first directional setting.

In some embodiments, the fan 166 may be bidirectional, and configured to blow air in both an upward and a downward direction within the internal chamber 160. For example, as shown in FIG. 1C, in a first directional setting, the fan 166 may be configured to move air from the lower bunk assembly 102 to the upper bunk assembly 104. In this configuration, the valve 170 may be open, allowing air to enter the internal chamber 160 through the first intake vent 162. The valves 180, 182, and 184 may also be open, allowing air to exit the internal chamber 160 through the outflow vents 140 and 142, and hose 144. The valve 172 may be closed, preventing air from exiting the internal chamber 160 through the second intake vent 164. The valves 174, 176, and 178 may also be closed, preventing air from exiting the internal chamber 160 through the outflow vents 134 and 136, and hose 138.

Figure 1D:
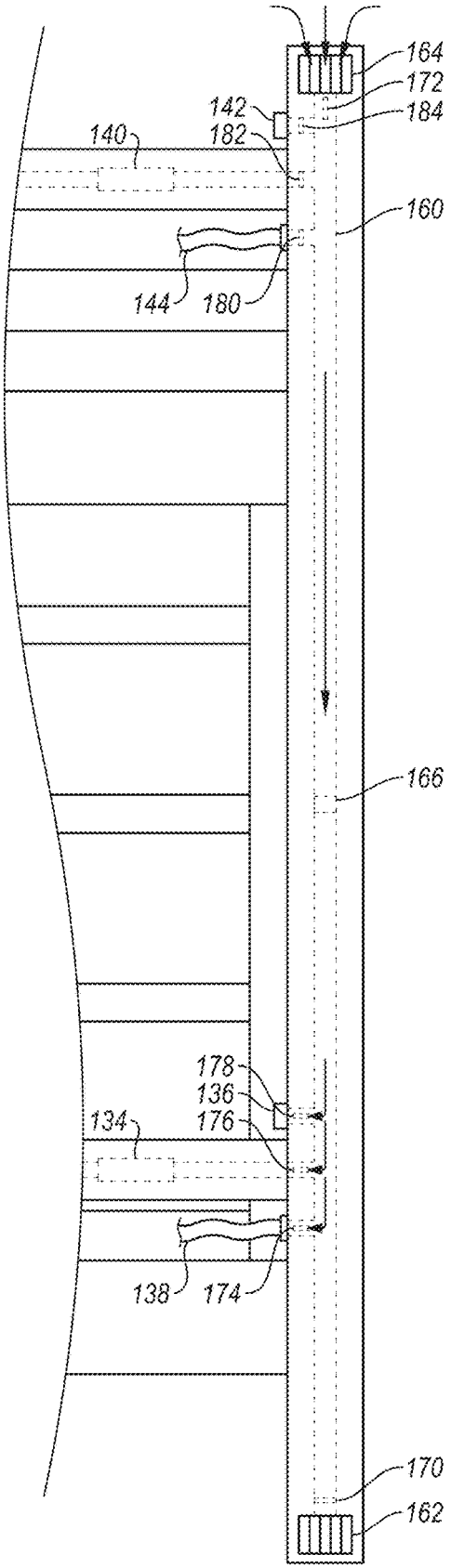
FIG. 1D illustrates a back view of the first system for circulating air through a bed frame in a second directional setting.

FIG. 1D illustrates a second directional setting, where the fan 166 may be configured to move air from the upper bunk assembly 104 to the lower bunk assembly 102. In this configuration, the valve 172 may be open, allowing air to enter the internal chamber 160 through the second intake vent 164. The valves 174, 176, and 178 may also be open, allowing air to exit the internal chamber 160 through the outflow vents 134 and 136, and hose 138. The valve 170 may be closed, preventing air from exiting the internal chamber 160 through the first intake vent 162. The valves 180, 182, and 184 may also be closed, preventing air from exiting the internal chamber 160 through the outflow vents 140 and 142, and hose 144.

In one exemplary method for moving air from the lower bunk assembly 102 to the upper bunk assembly 104, a first step may include opening the valve 170 to allow air to enter the internal chamber 160 through the first intake vent 162. A second step may include opening one or more of the valves 180, 182, and 184 to allow air to exit the internal chamber 160 through one or more of the outflow vents 140 and 142, and hose 144. A third step may include closing the valve 172 to prevent air from exiting the internal chamber 160 through the second intake vent 164. A fourth step may include closing the valves 174, 176, and 178 to prevent air from exiting the internal chamber 160 through the outflow vents 134 and 136, and hose 138. Finally, a fifth step may include causing the fan 166 to rotate in a direction that pulls air through the first intake vent 162 and out through one or more of the outflow vents 140 and 142, and hose 144.

In another exemplary method for moving air from the upper bunk assembly 104 to the lower bunk assembly 102, a first step may include opening the valve 172 to allow air to enter the internal chamber 160 through the second intake vent 164. A second step may include opening one or more of the valves 174, 176, and 178 to allow air to exit the internal chamber 160 through one or more of the outflow vents 134 and 136, and hose 138. A third step may include closing the valve 170 to prevent air from exiting the internal chamber 160 through the first intake vent 162. A fourth step may include closing the valves 180, 182, and 184 to prevent air from exiting the internal chamber 160 through the outflow vents 140 and 142, and hose 144. Finally, a fifth step may include causing the fan 166 to rotate in a direction that pulls air through the second intake vent 164 and out through one or more of the outflow vents 134 and 136, and hose 138.

Modifications, additions, or omissions may be made to the first system 100 for circulating air through a bed frame without departing from the scope of the present disclosure. For example, in some embodiments, the system 100 may include additional components similar to the components illustrated in FIGS. 1A, 1B, 1C, and 1D that each may be configured similarly to the components illustrated in these figures. In one such embodiment, a system may only include a single intake vent. For example, a bed frame may include only the first intake vent 162 and only one or more of the outflow vents 140 and 142. Alternatively, a bed frame may include only the second intake vent 164 and only one or more of the outflow vents 134 and 136. In other embodiments, the chamber need not be entirely within a bed frame. In some embodiments, all or a portion of the chamber may be external to the bed frame. In these embodiments, the chamber may be secured to a portion of the bed frame.

Figure 2A:
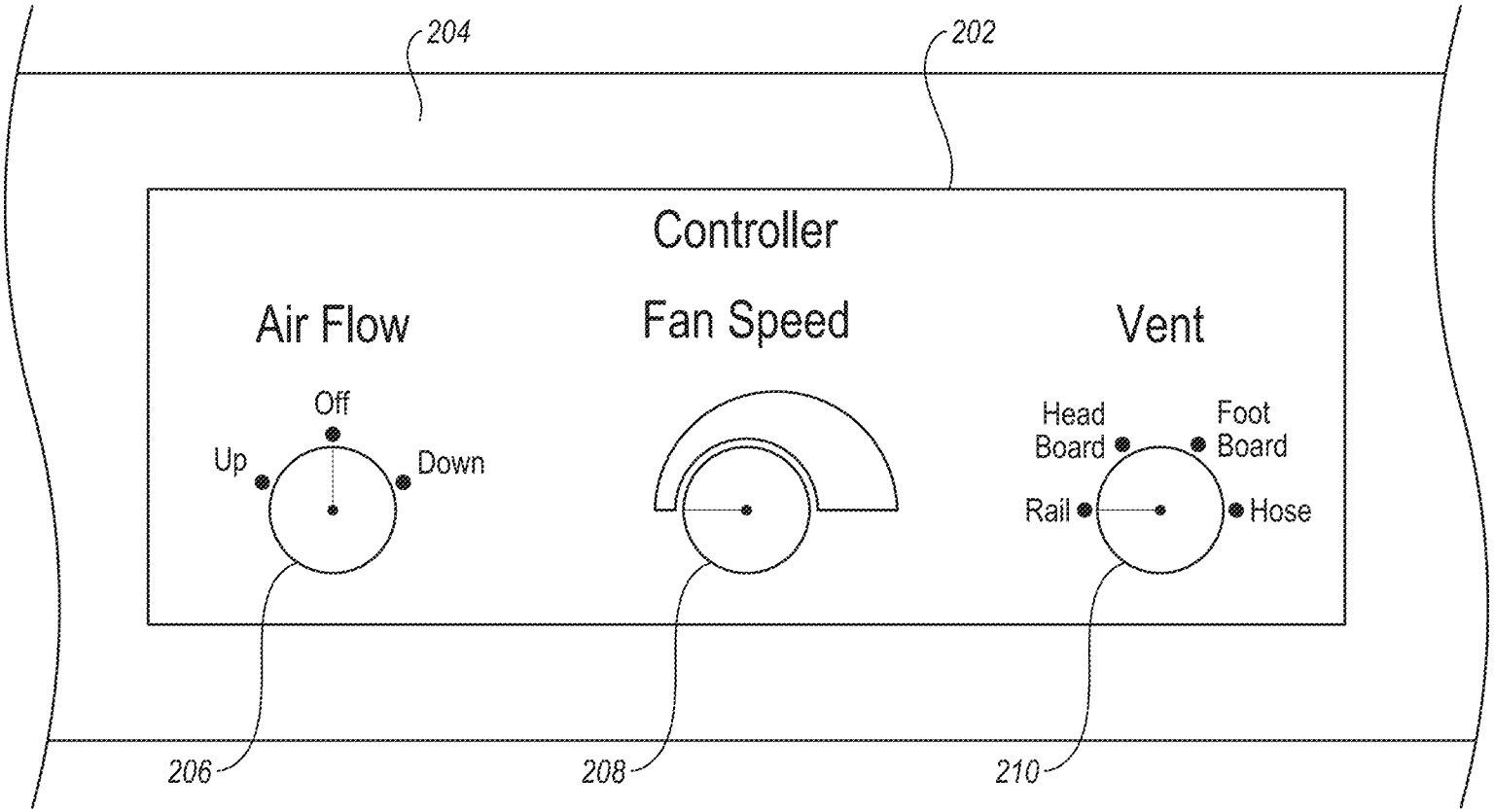
FIG. 2A illustrates a first controller configuration.
Figure 2B:
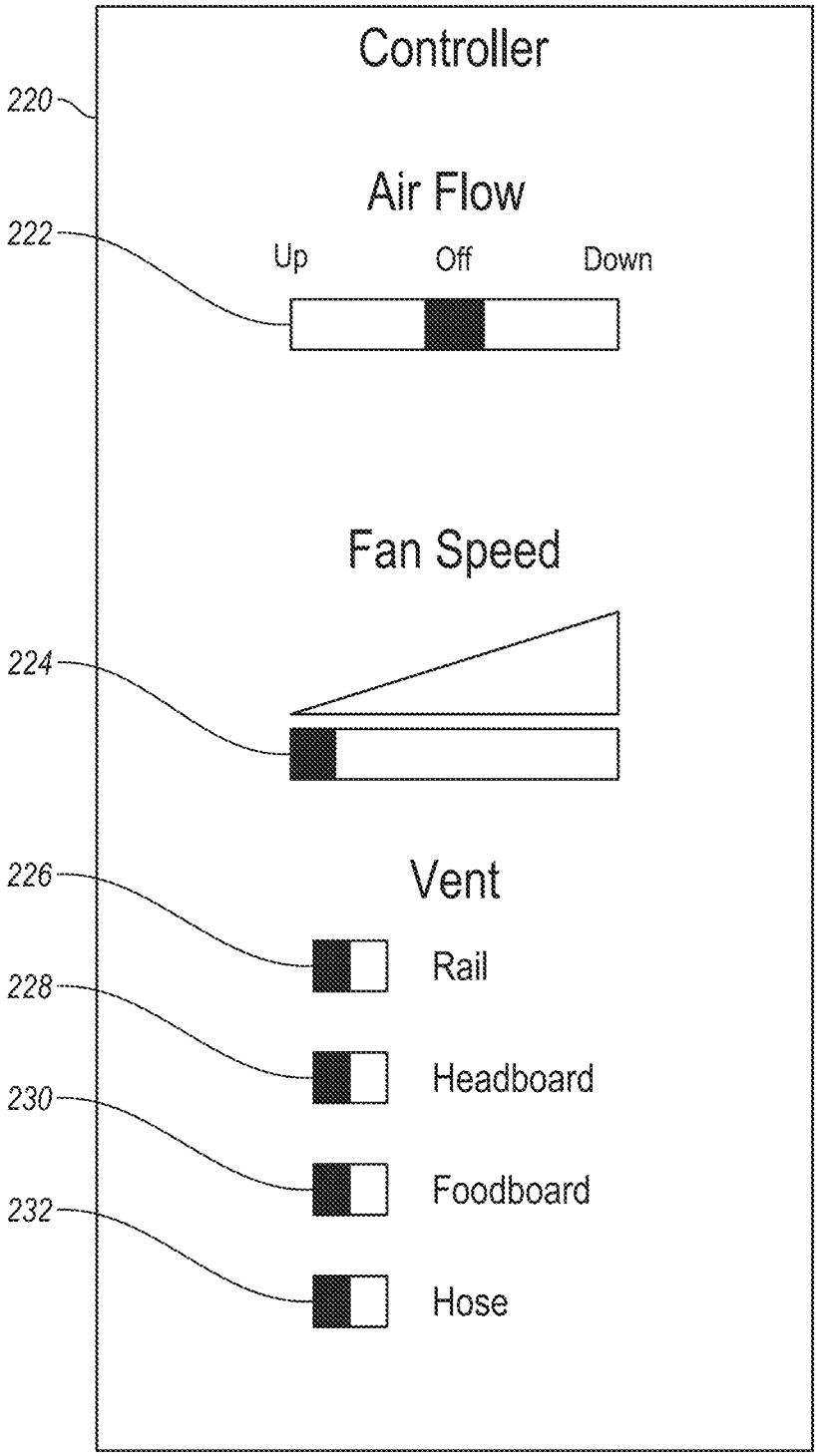
FIG. 2B illustrates a second controller configuration.

FIGS. 2A and 2B illustrate two possible configurations of controllers. The controller 202 illustrated in FIG. 2A may be secured to a portion of a bed frame 204. The controller 202 may be in wired communication with the electrical components of a system for circulating air through a bed frame. For example, the controller 202 may be in wired communication with one or more fans and one or more valves that selectively open and close access by an internal chamber to one or more vents. Controllers may use any type of dials, buttons, knobs, switches, etc. to control the electrical components of the system.

The controller 202 may include a dial 206 that is configured to control whether the fan is on or off and a direction that the fan is configured to rotate (moving air up an internal chamber or down an internal chamber). The controller 202 may also include a dial 208 that is configured to control the speed of the fan. The controller 202 may further include a dial 210 that is configured to determine the outflow vent(s) that air is released through. For example, if the dial 210 selects the "rail" option, a valve that is associated with one or more rail vents may be opened, while valves associated with other vents (such as a headboard vent, a footboard vent, a hose vent, etc.) are closed. In some embodiments, the controller 202 may allow vents to be selected individually, so that a user can determine which vents to open and which vents to close individually such that a plurality of vents may be opened at the same time.

The controller 220 illustrated in FIG. 2B may in wireless communication with the electrical components of a system for circulating air through a bed frame. For example, the controller 220 may be in wireless communication with one or more fans and one or more valves that selectively open and close access by an internal chamber to one or more vents.

The controller 220 may include a slide 222 that is configured to control whether the fan is on or off and a direction that the fan is configured to rotate (moving air up an internal chamber or down an internal chamber). The controller 220 may also include a slide 224 that is configured to control the speed of the fan. The controller 202 may include a switch 226 that is configured to determine whether a valve associated with an outflow vent in a rail is opened or closed. A switch 228 may be configured to determine whether a valve associated with an outflow vent in a headboard is opened or closed. A switch 230 may be configured to determine whether a valve associated with an outflow vent in a footboard is opened or closed. A switch 232 may be configured to determine whether a valve associated with hose vent is opened or closed.

In some embodiments, the bed frame may be WiFi enabled and the electrical components of a system for circulating air through a bed frame may be connectable to a wide area network, such as the Internet. In this embodiment, an application may be downloaded to a user device, such as a smartphone, to control the operation of the functions of the bed frame. In these embodiments, the application may display an interface on the device screen that includes controls for the fan speed and direction, and vent controls. In other embodiments, the wireless communication may be based on a radio or light frequency.

Figure 3:
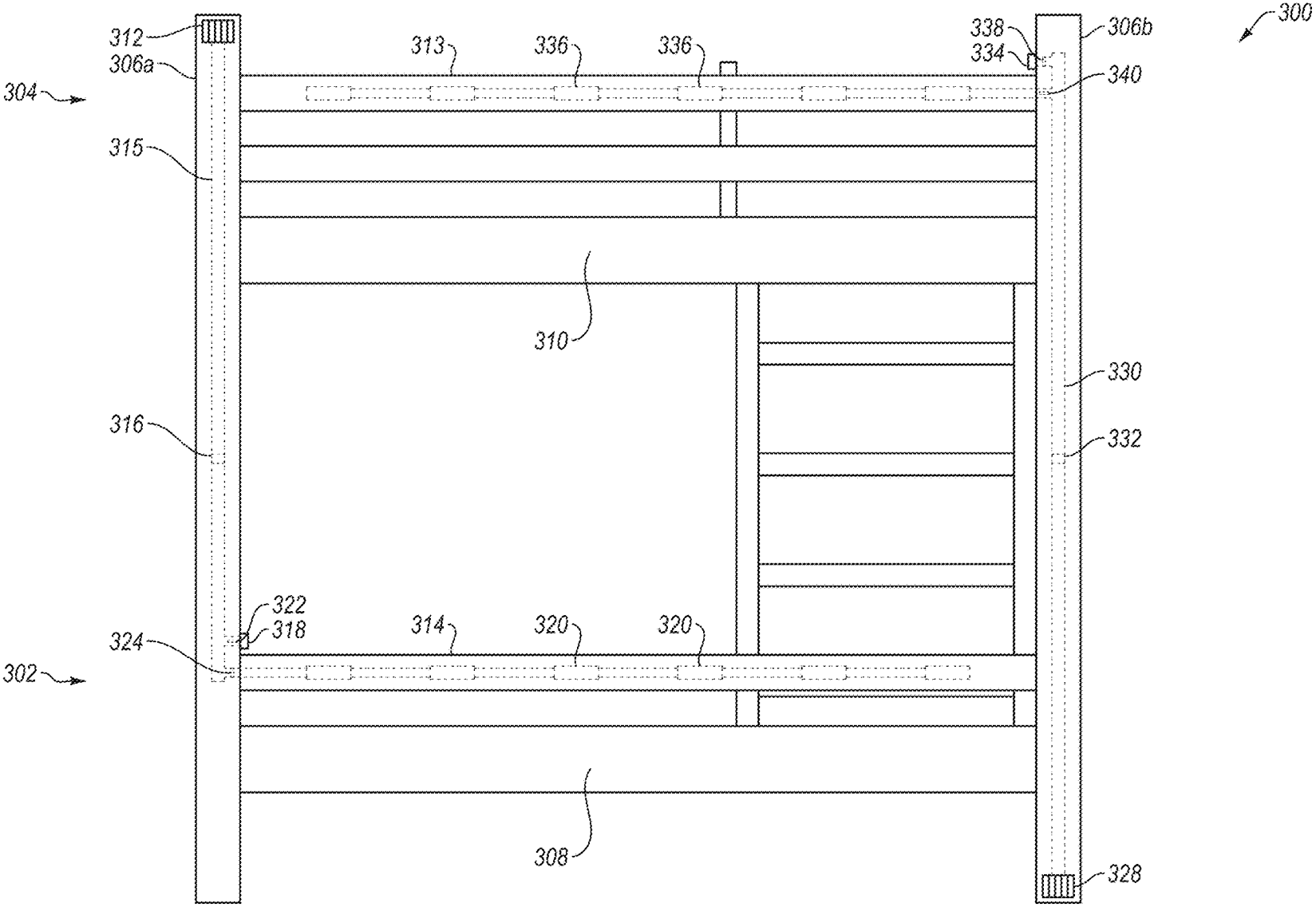
FIG. 3 illustrates a back view of a second system for circulating air through a bed frame.

In some embodiments, a bed frame may include more than one internal chamber that are separated from one another. For example, a second system 300 for circulating air through a bed frame is illustrated in FIG. 3. The second system 300 is a bunk bed having a lower bunk assembly 302 and an upper bunk assembly 304. The upper and lower bunk assemblies 302 and 304 share a first vertical support leg 306*a* and a second vertical support leg 306*b*. The lower bunk assembly 302 includes a lower mattress platform 308 and a horizontal guard rail 314. The upper bunk assembly 304 includes an upper mattress platform 310 and a horizontal guard rail 313.

A first vent 312 is in the first vertical support leg 306*a* of the upper bunk assembly 304. The first vent 312 is in fluid communication with a first internal chamber 315. A first fan 316 is inside of the first internal chamber 315. A first headboard vent 318 is in fluid communication with the first internal chamber 315 and is positioned in a headboard portion of the lower bunk assembly 302. First rail vents 320 are in fluid communication with the first internal chamber 315 and are positioned in the horizontal guard rail 314 of the lower bunk assembly 302. A valve 322 is associated with the first headboard vent 318 and is configured to selectively open and close access by the first internal chamber 315 to the first headboard vent 318. A valve 324 is associated with the first rail vents and is configured to selectively open and close access by the first internal chamber 315 to the first rail vents 320.

The first fan 316 may be configured to move air from the first vent 312 to the first headboard vent 318 and the first rail vents 320. A first controller (not shown) may control whether the first fan 316 is on or off, a speed of the fan, and whether the valves 322 and 324 are opened or closed.

A second vent 328 is in the second vertical support leg 306*b* of the lower bunk assembly 302. The second vent 328 is in fluid communication with a second internal chamber 330. A second fan 332 is inside of the second internal chamber 330. A second headboard vent 334 is in fluid communication with the second internal chamber 330 and is positioned in a headboard portion of the upper bunk assembly 304. Second rail vents 336 are in fluid communication with the second internal chamber 330 and are positioned in the horizontal guard rail 313 of the upper bunk assembly 304. A valve 338 is associated with the second headboard vent 334 and is configured to selectively open and close access by the second internal chamber 330 to the second headboard vent 334. A valve 340 is associated with the second rail vents and is configured to selectively open and close access by the second internal chamber 330 to the second rail vents 336.

The second fan 332 may be configured to move air from the second vent 328 to the second headboard vent 334 and the second rail vents 336. A second controller (not shown) may control whether the second fan 332 is on or off, a speed of the fan, and whether the valves 338 and 340 are opened or closed. In some embodiments, a single controller may control the operation of both the first fan 316 and the valves 322 and 324 as well as the second fan 332 and the valves 338 and 340.

The internal chambers 315 and 330 may not be in fluid communication with one another. In some embodiments, independent internal chambers may be included within a single portion of a bed frame. For example, in another embodiment, the internal chambers 315 and 330 may both be within the vertical support leg 306*a*.

Figure 4:
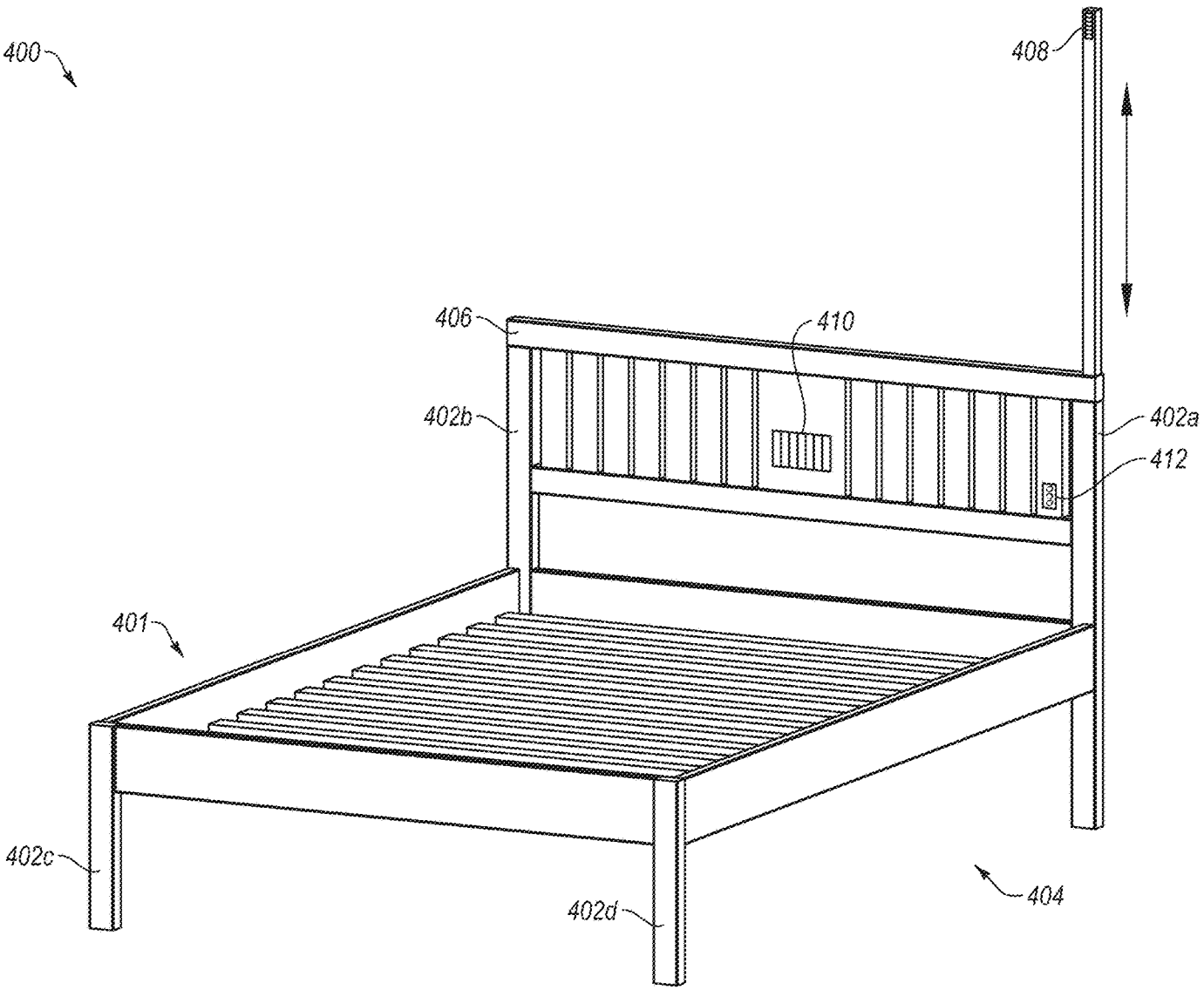
FIG. 4 illustrates a perspective view of a third system for circulating air through a bed frame.

A third system 400 for circulating air through a bed frame is illustrated in FIG. 4. The system 400 includes a bed frame 401 having a first vertical support leg 402*a*, a second vertical support leg 402*b*, a third vertical support leg 402*c*, a fourth vertical support leg 402*d*, a mattress platform 404, and a headboard 406. The system 400 also includes an intake vent 408 in an upper portion of the first vertical support leg 402*a*. The first vertical support leg 402*a* may have a height that is selectively extendable. For example, the first vertical support leg 402*a* may have a telescoping mechanism that allows a user to extend the height of the leg upward. This may enable a user to position the intake vent 408 near a ceiling of a room in which the bed frame 401 is located. The intake vent 408 may be in fluid communication with an internal chamber (not shown) that is enclosed within the bed frame 401. The internal chamber may be in fluid communication with one or more outflow vents in the bed frame 401. For example, an outflow vent 410 may be in the headboard 406. The internal chamber may include a fan that moves air from the intake vent 408 to the outflow vent 410. A controller 412 may selectively control whether the fan is on or off and a speed of the fan when it is on. The controller 412 may also selectively adjust the height of the first vertical support leg 402*a*. Alternatively, the height of the first vertical support leg 402*a* may be adjusted manually. Additional outflow vents may be located on the bed frame 401. For example, additional outflow vents may be positioned in the mattress platform 404 and direct air from the intake vent 408 into a mattress that is positioned on the mattress platform 404.

Figure 5:
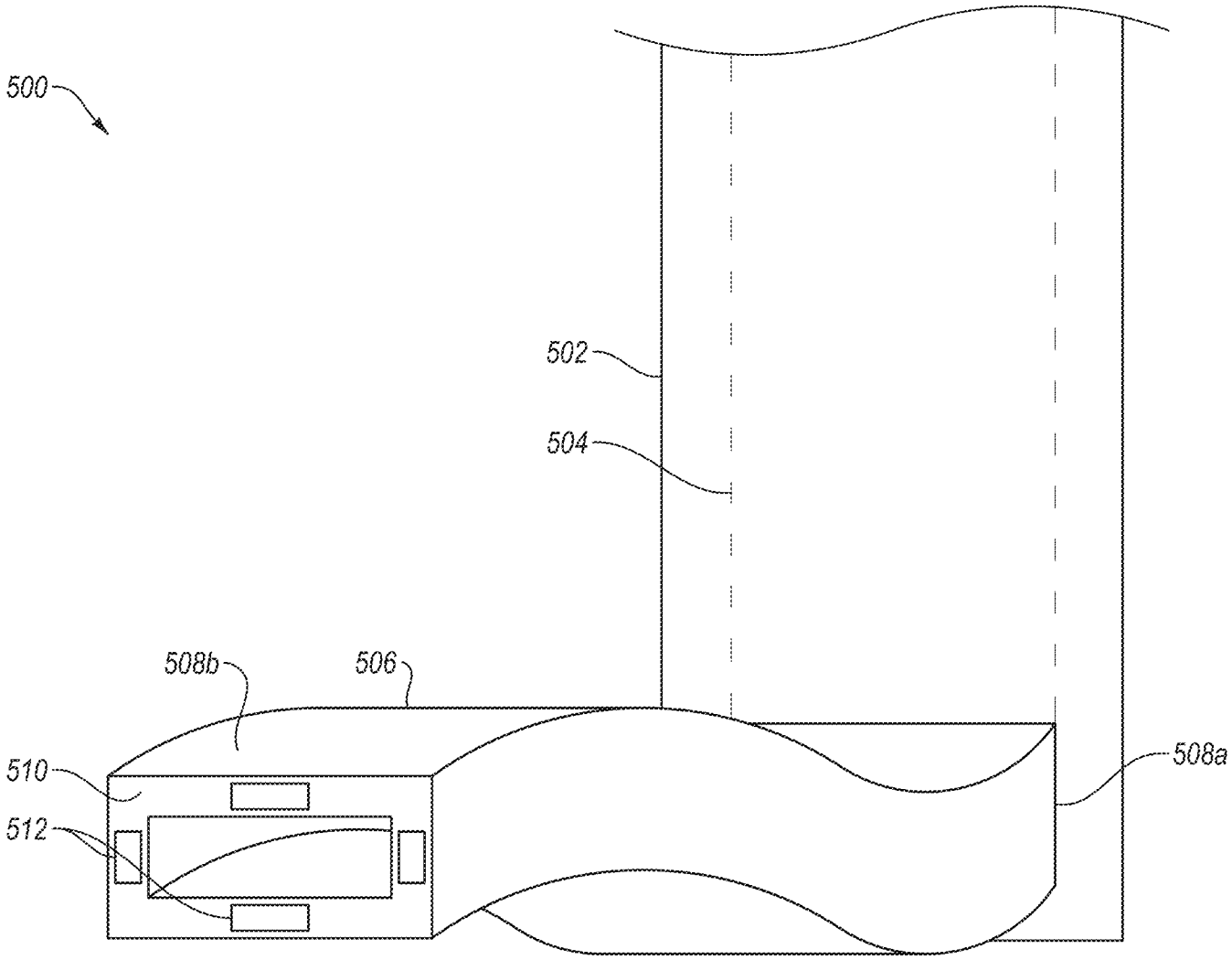
FIG. 5 illustrates an air intake device for use in a system for circulating air through a bed frame.

FIG. 5 illustrates an air intake device 500 for use in a system for circulating air through a bed frame. The air intake device 500 includes a length of pliable duct 506 that may be secured at a first end 508*a* to an intake vent that is in fluid communication with an internal chamber 504 that is within a support leg 502 of a bed frame. A second end 508*b* of the pliable duct 506 may include a housing 510 that is configured to be secured to all or part of a heating, ventilation, and air conditioning (HVAC) wall register. For example, the housing 510 may include one or more magnets 512 that are configured to be secured to a portion of an HVAC wall register. In other embodiments, the housing 510 may include a platform that allows the housing to be placed on a surface directly in front of an HVAC wall register.

In accordance with common practice, the various features illustrated in the drawings may not be drawn to scale. The illustrations presented in the present disclosure are not meant to be actual views of any particular apparatus (e.g., device, system, etc.) or method, but are merely example representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the summary, detailed description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absent a showing that the terms "first," "second," "third," etc., connote a specific order, these terms should not be understood to connote a specific order. Furthermore, absent a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

The foregoing description, for purpose of explanation, has been described with reference to specific embodiments. However, the illustrative discussions above are not intended to be exhaustive or to limit the invention as claimed to the precise forms disclosed. Many modifications and variations are possible in view of the above teachings. The embodiments were chosen and described to explain practical applications, to thereby enable others skilled in the art to utilize the invention as claimed and various embodiments with various modifications as may be suited to the particular use contemplated.

The invention claimed is:

1. A system for circulating air through a bed frame, the system comprising:

a bunk bed frame, having a lower bunk assembly and an upper bunk assembly, that defines an internal chamber that extends within the bunk bed frame from the lower bunk assembly to the upper bunk assembly;

a first vent in the lower bunk assembly, the first vent being configured to receive air from outside the internal chamber to inside the internal chamber;

a second vent in the upper bunk assembly, the second vent being configured to expel air from inside the internal chamber to outside the internal chamber; and a fan disposed within the internal chamber between the first vent and the second vent, the fan being configured to move air within the internal chamber from the first vent to the second vent.

2. The system of claim 1, wherein:

the first vent is also configured to expel air from inside the internal chamber to outside the internal chamber, the second vent is also configured to receive air from outside the internal chamber to inside the internal chamber, and the fan is bidirectional such that in a first directional setting, the fan is configured to move air within the internal chamber from the first vent to the second vent, and in a second directional setting the fan is configured to move air within the internal chamber from the second vent to the first vent.

3. The system of claim 2, further comprising a controller that is configured to adjust the directional setting of the fan.

4. The system of claim 3, wherein the controller is further configured to adjust a speed setting of the fan.

5. The system of claim 4, wherein the controller is in wired communication with the fan.

6. The system of claim 4, wherein the controller is in wireless communication with the fan.

7. A system for circulating air through a bed frame from a lower elevation to a higher elevation, the system comprising:

a bed frame that includes a horizontal guard rail, wherein the bed frame defines an internal chamber that has a lower end at or near a bottom of the bed frame and a higher end at or near a top of the bed frame, the internal chamber extending, at least partially, into the horizontal guard rail at or near the higher end of the internal chamber;

an intake vent at or near the lower end of the internal chamber, the intake vent being configured to receive air into the internal chamber;

an outflow vent in the horizontal guard rail at or near the higher end of the internal chamber, the outflow vent being configured to expel air from inside the internal chamber; and a fan within the internal chamber, the fan being configured to move air within the internal chamber from the intake vent to the outflow vent.

8. The system of claim 7, further comprising a length of duct having a first end and a second end, wherein the first end of the length of duct is connected to the intake vent and the second end of the length of duct is configured to be secured to all or part of a heating, ventilation, and air conditioning ("HVAC") wall register.

9. The system of claim 7, wherein the outflow vent is adjustable such that a direction that air is configured to be expelled from inside the chamber is configured to be pointed in a desired direction.

10. The system of claim 7, wherein the bed frame includes a headboard and the outflow vent is in the headboard.

11. The system of claim 7, further comprising a tube that is connected, at one end, to the outflow vent.

12. A system for circulating air through a bed frame, the system comprising:

a bunk bed frame having a lower bunk assembly and an upper bunk assembly;

an internal chamber that extends within the bunk bed frame from the lower bunk assembly to the upper bunk assembly;

a first intake vent in the lower bunk assembly that is configured to receive air from outside the internal chamber to inside the internal chamber;

a first outflow vent in the upper bunk assembly that is configured to expel air from inside the internal chamber to outside the internal chamber;

a second intake vent in the upper bunk assembly that is configured to receive air from outside the internal chamber to inside the internal chamber;

a second outflow vent in the lower bunk assembly that is configured to expel air from inside the internal chamber to outside the internal chamber;

a bidirectional fan disposed within the internal chamber wherein, in a first directional setting, the bidirectional fan is configured to pull air into the internal chamber through the first intake vent and expel air from within the internal chamber through the first outflow vent and, in a second directional setting, the bidirectional fan is configured to pull air into the internal chamber through the second intake vent and expel air from within the internal chamber through the second outflow vent; and a controller that is configured to control the directional setting of the bidirectional fan.

13. The system of claim 12, further comprising:

a first intake valve that selectively opens and closes access by the internal chamber to the first intake vent;

a first outflow valve that selectively opens and closes access by the internal chamber to the first outflow vent;

a second intake valve that selectively opens and closes access by the internal chamber to the second intake vent; and a second outflow valve that selectively opens and closes access by the internal chamber to the second outflow vent.

14. The system of claim 13, wherein:

in the first directional setting, the first intake valve and the first outflow valve are in open positions and the second intake valve and the second outflow valve are in closed positions, and in the second directional setting the first intake valve and the first outflow valve are in closed positions and the second intake valve and the second outflow valve are in open positions.

15. The system of claim 12, wherein:

the upper bunk assembly includes a headboard, and the first outflow vent is positioned in the headboard of the upper bunk assembly.

16. The system of claim 12, wherein:

the upper bunk assembly includes a horizontal guard rail, and the first outflow vent is positioned in the horizontal guard rail of the upper bunk assembly.

17. The system of claim 12, further comprising a tube connected at one end to the first outflow vent of the upper bunk assembly.

* * * * *